United States Patent [19]

Vidal et al.

[11] Patent Number: 4,790,690

[45] Date of Patent: Dec. 13, 1988

[54] STABILISED EARTH STRUCTURES

[75] Inventors: Henri Vidal, 8 bis, Boulevard Maillot Neuilly-sur-Seine, France; Daniel Weinreb, Rexdale, Canada

[73] Assignee: Henri Vidal, Neuilly-sur-Seine, France

[21] Appl. No.: 7,994

[22] Filed: Jan. 29, 1987

[30] Foreign Application Priority Data

Feb. 5, 1986 [GB] United Kingdom ..... 8602783

[51] Int. Cl.[4] ..... E02D 29/02

[52] U.S. Cl. ..... 405/262; 405/284; 405/286

[58] Field of Search ..... 405/31, 284, 285, 286, 405/287, 224, 222, 262

[56] References Cited

U.S. PATENT DOCUMENTS

| | | | |
|---|---|---|---|
| 3,198,614 | 8/1965 | Powell | 405/285 |
| 3,613,382 | 10/1971 | Dickinson | 405/285 |
| 3,869,868 | 3/1975 | Irsai . | |
| 4,154,552 | 5/1979 | van Bilderbeek . | |
| 4,440,527 | 4/1984 | Vidal . | |
| 4,470,728 | 9/1984 | Broadbent | 405/284 |
| 4,659,261 | 4/1987 | Chiaves | 405/286 |

FOREIGN PATENT DOCUMENTS

| | | |
|---|---|---|
| 0047610 | 3/1982 | European Pat. Off . |
| 2315572 | 1/1977 | France . |
| 2400099 | 3/1979 | France . |
| 2436851 | 4/1980 | France . |
| 610966 | 5/1979 | Switzerland . |

*Primary Examiner*—David H. Corbin

*Attorney, Agent, or Firm*—Burns, Doane, Swecker & Mathis

[57] ABSTRACT

A method of constructing a stabilised earth structure under water comprises lowering a row of base units on to a site under water, lowering into a position immediately above said base units facing units to which are attached in a row elongate flexible reinforcements for stabilising the earth, the facing units being guided during lowering by rigid guide members connected to the base units, and backfilling the base and facing units with earth to cover the reinforcements. Each base unit comprises an elongate box and fluid concrete is introduced into the elongate box and allowed to harden to support the respective facing unit with its lower edge horizontal even if the base unit rests on a slope. Each guide member is connected to a respective elongate box so as to be adjustable to a vertical orientation.

12 Claims, 11 Drawing Sheets

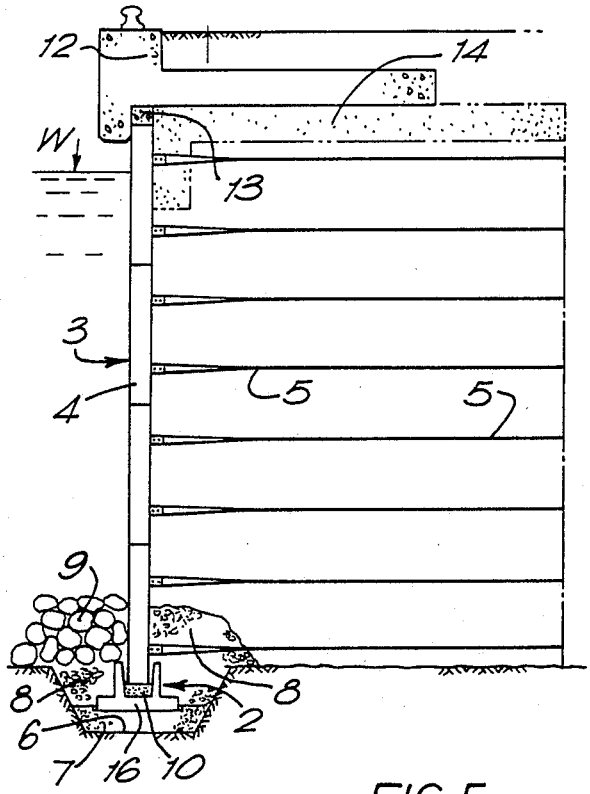
FIG. 1.
FIG. 4.
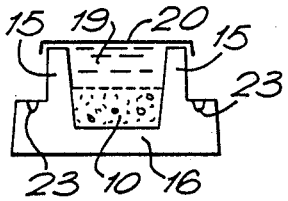
FIG. 5.
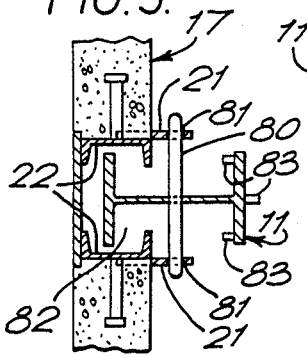
FIG. 5a.
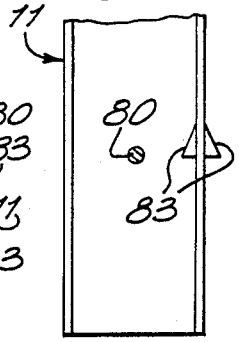

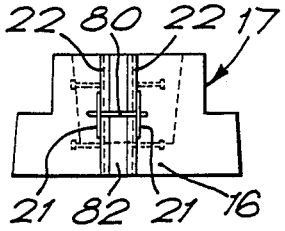
FIG.6.
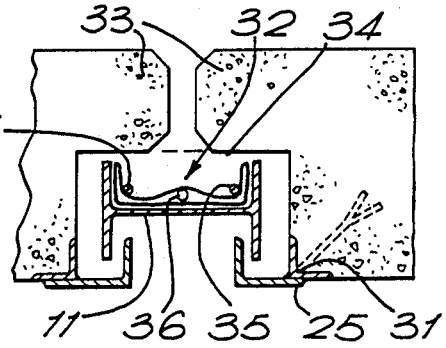
FIG.9.
FIG.7.
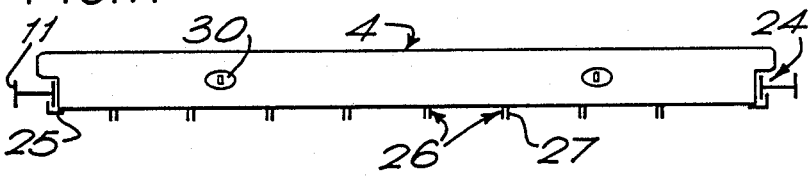
FIG.8.
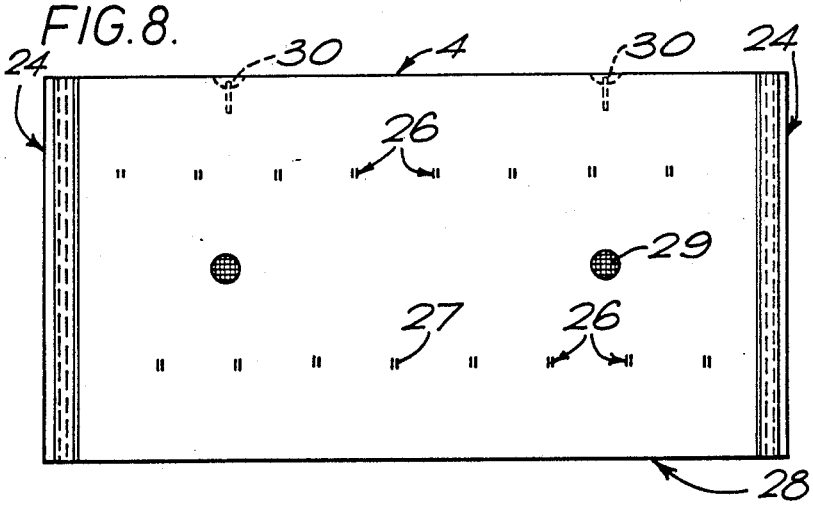

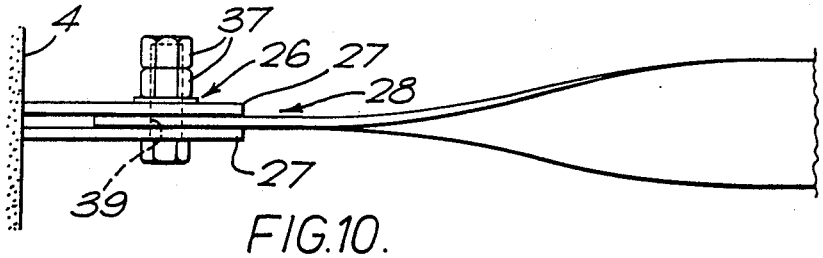
FIG.10.
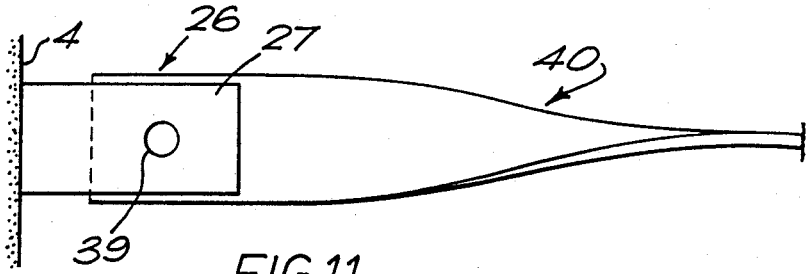
FIG.11.
FIG.12.
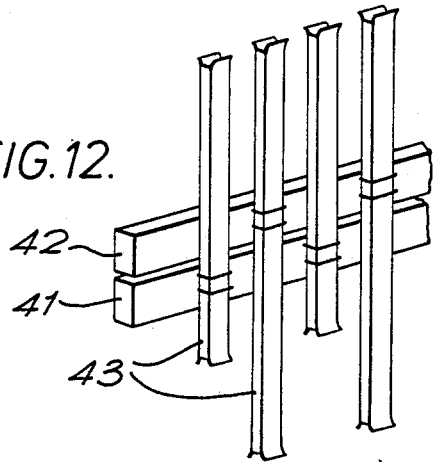

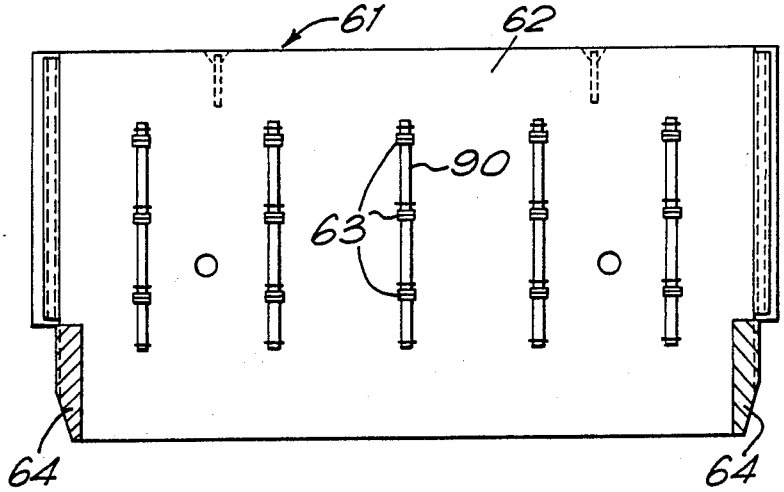
FIG. 20.
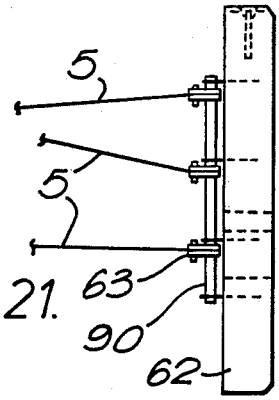
FIG. 21.
FIG. 22.
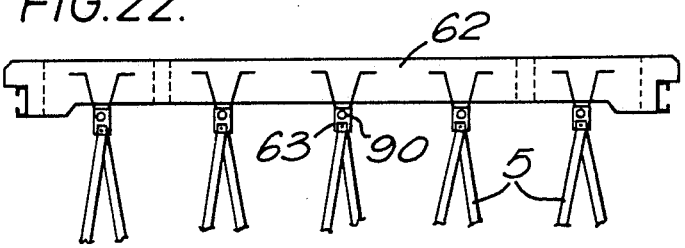

STABILISED EARTH STRUCTURES

This invention is concerned with improvements in or relating to stabilised earth structures under water, such as for example, sea walls, wharfs, docks etc.

The technique of stabilising earth structures by incorporation of spaced flexible reinforcements in an earth mass has become well established. The basic principles of this procedure were set out in British Pat. No. 1039361 of Henri Vidal. The reinforcements stabilise the mass virtually completely by frictional forces, both between the reinforcements and the adjacent fill particles and between those particles and the remainder of the fill. The reinforcements are so spaced that the frictional forces are transmitted throughout the fill and tension generated in the reinforcements opposes significant horizontal movement of the fill particles. A preferred type of reinforcement in these structures is an elongate flat steel strip which in use lies in the fill with its flat faces horizontal and with one end attached to a facing unit such as that disclosed in GB No. 1324686.

Clearly it is desirable to obtain accurate positioning of both the facing units and the spaced reinforcement strips during construction and these requirements can be adequately met when constructing stabilised earth structures on land Each facing unit is installed and backfilled with earth which is compacted up to the predetermined level of the reinforcement strips. These can then be attached to the unit and laid in position on the backfill. Further backfilling and compaction takes place up to the next level of reinforcement and so on until a stabilised earth structure is formed to the required height.

Attempts to build these structures under water have met difficulties in positioning the reinforcements and laying the backfill. In general, it is difficult to use divers, since visibility conditions on site are usually inadequate.

It is known from U.S. Pat. No. 4,440,527 of Henri Vidal to avoid under water attachment of the reinforcing strips to the facing unit by mounting them pivotably to the unit and keeping them upwardly pivoted until backfilling up to the level of reinforcement has been completed. In this method the facing unit is guided into position under water by means of flexible guide cables which extend upwards from a base unit placed on the sea or river bed. Each guide cable is supported on the water surface by a buoy from which it must be detached when it is to be inserted through a corresponding vertical guide passage in the facing unit to be lowered. Furthermore, it is generally necessary to ensure that the construction site is horizontal so that the base and facing units will be correctly positioned.

In accordance with one aspect of the invention there is provided a method of constructing a stabilised earth structure under water, comprising lowering a base unit on to a site under water, lowering into a position immediately above said base unit a facing unit to which is attached at least one elongate flexible reinforcement for stabilising the earth, the facing unit being guided during lowering by at least one guide member connected to the base unit, and backfilling the base and facing units with earth to cover the or each reinforcement, wherein the base unit comprises an elongate box and support material is introduced into said elongate box to provide means for supporting said facing unit with its lower edge horizontal, the guide member being substantially rigid and connected to the elongate box such that the rigid guide member is adjustable to a vertical orientation.

In accordance with another aspect of the invention there is provided a stabilised earth structure at least partly under water, in which an under water base unit supports a facing unit to which is attached at least one elongate flexible reinforcement for stabilising the earth behind the facing unit, at least one guide member for the facing unit being connected to the base unit, wherein the base unit comprises an elongate box containing support material which supports the lower edge of said facing unit horizontally, the guide member being substantially rigid and adjusted relative to the elongate box to a vertical orientation.

In accordance with a further aspect of the invention there is provided a base unit for an under water stabilised earth structure, having connected thereto a guide member for a facing unit, and wherein the base unit comprises an elongate box for containing support material to support a facing unit, the guide member being substantially rigid and connected to the elongate box such that the orientation of the guide member is adjustable.

With such arrangements, the elongate box which forms the base unit can rest on a sloping site e.g. a gravel bed at an angle to the horizontal while the support material ensures that the facing unit is supported with its lower edge horizontal.

Engagement between the facing unit, which will generally be rectangular, and the rigid guide member can then ensure that the latter extends vertically, any necessary adjustment of the guide member relative to the elongate box being permitted by the adjustable form of connection therebetween.

The support material may for example be crushed stone or gravel which is introduced into the elongate box while the facing unit is held e.g. by a crane with its lower edge horizontal and within the volume of the elongate box. The support material is introduced to fill at least the volume of the box up to and touching the lower edge of the facing unit so that when the latter is released, the stone or gravel supports it in the correct position. Preferably, however, the support material is concrete which remains fluid until the elongate box is installed on the site, so that when the concrete hardens it provides a horizontal pad for supporting the facing unit when the latter is lowered into position. The concrete may be introduced into the elongate box before it is lowered into the water, in which case the required quantity can be determined in accordance with the gradient of the site. Protection for the fluid concrete can be provided by topping up the box with fresh water and covering with a temporary lid. Alternatively the concrete can be introduced into the box once it has been installed e.g. by means of a tremie. This procedure is of advantage when a number of boxes are to be lowered, since a larger amount of concrete can be mixed at one time and then divided between the separate boxes.

In general a plurality of elongate boxes will be lowered to form a row thereof with a respective guide member between adjacent boxes and at each end of the row, and facing units will be lowered between the guide members to form a row thereof. Thus in a preferred method the first box to be lowered supports a pair of said guide members, one at each longitudinal end thereof, and a second box is engaged at one end thereof with one of said guide members for guided lowering until it is adjacent the first box, the second box supporting at its other end a third guide member. This process could be continued with additional boxes to form a row thereof and a row of spaced guide members.

The guidance of a box during lowering is generally achieved by a positive interlock between a portion of the box and a guide member supported by a previously lowered box. In a preferred embodiment, each such guide member has an H-shaped transverse section including two flanges joined by a web and is supported by the previously lowered box with the web parallel to the longitudinal axis of the box, one flange of the section being received in a slot at the end of the previously lowered box, and the other flange of the section serving to guide a new box during lowering. In such an arrangement, the adjustable orientation of the guide member can be achieved by mounting the guide member on the previously lowered box to pivot about an axis perpendicular to the web.

Clearly it is important that the boxes be accurately positioned relative to each other as their position will determine the position of subsequently placed facing units. Thus a guide member which serves to guide a box during lowering might include in its lower region means for locating a box relative to the previously lowered box which supports the guide member. For example, if the guide member is an H-section as referred to above, the slot of the box being lowered might be arranged to receive the guiding web of the H-section relatively loosely, and the web may include wedge members in the lower region of the guide member for ensuring that the slot of the box adopts the correct final position relative to the guide member. This will assist the correct positioning of all elongate boxes at the base of the structure.

The facing of the structure may be a straight wall in plan view, or it may be desired to include bends in the wall. Such design variations can be accommodated by appropriate positioning of the portion of a box which interlocks with a guide member already installed. For example, a previously positioned box might support a guide member at one longitudinal end, while the interlocking portion of a box to be lowered might be provided in a side wall of the box, thereby providing a right-angle bend in the facing of the structure. Other angles could also be provided. In order to ensure that reinforcements extending from different parts of the facing at an angle do not interfere with each other the first row of facing units for one part may be of reduced e.g. half the normal height of the first row facing units of the other part.

The facing unit will generally have at each end slot means for engagement with adjacent guide members, and a column of facing units will normally be stacked on the or each elongate box. In order to avoid loss of backfill material through the facing of the structure, each guide member is preferably provided with a vertically extending bag into which sealing material e.g. grout is introduced to form a seal between adjacent facing units.

It is not generally possible to compact the backfill under water to the same extent that compaction can be effected on land, so the backfill may be subject to unknown settlements. Preferably, therefore the or each reinforcement is attached to the facing unit(s) by means which permits limited downward movement of the reinforcement relative to the unit so as to allow for unknown backfill settlements.

One way of achieving this is to provide a vertically extending elongate member e.g. a tube or pipe on the rear of the facing unit with one or more reinforcements secured to the member to be vertically movable thereon. Preferably a plurality of vertically spaced reinforcements are attached to a vertically extending elongate member on the rear of the or each facing unit.

The facing unit will generally comprise a panel having a plurality of vertically spaced rows of reinforcements. It is desirable to minimise the total number of vertical members provided on the facing unit for attachment of reinforcements since they will generally be heavy and also costly. Thus in a preferred embodiment two adjacent reinforcements attached to the same vertical member and vertically spaced thereon will diverge from each other when viewed in plan.

In a preferred method the or each reinforcement is supported by means disposed at a location along its length spaced from a respective facing unit such that both during and after lowering the unit into position the or each reinforcement is supported substantially horizontally. With such a method, attachment of the or each reinforcement to the facing unit ready for lowering in the required horizontal position can conveniently be effected out of the water rather than under water, and then the whole assembly can be lowered. The facing unit will generally be backfilled, at which time the or each reinforcement is supported in the correct horizontal position for earth stabilisation.

It is generally envisaged that the level of the existing ground or backfill at the time of lowering the assembly will be below the desired final level of reinforcement, so that in a preferred method the supporting means is arranged to space the or each reinforcement vertically upwardly of the existing ground level. For example, the supporting means might comprise a cage having one or more legs adapted to rest on or partially penetrate the existing ground or backfill to provide the required spacing. Such a cage would be lowered at the same time as the facing unit, and indeed the cage and the unit might be suspended from a common jig during lowering, which jig might for example be lowered by a crane. It is desirable to retain the or each reinforcement relative to the cage and this is preferably achieved by using wire ties to connect the reinforcement(s) to the cage. The stability of the or each reinforcement during lowering and its correct positioning when in the lowered position might be improved by providing support at more than one location along its length, particularly for longer reinforcements. Such extra support could be provided by a single cage and/or by using more than one cage.

As described earlier, the facing unit may comprise a panel having a plurality i.e. two or more reinforcements arranged in a row. With such an arrangement a supporting cage preferably extends laterally to provide support for a complete row of reinforcements. For example, the cage might comprise a plurality of laterally spaced upright members each adapted to rest on or penetrate the existing ground or backfill, such members being interconnected by one or more laterally extending support members for a row of reinforcements. If the facing unit includes more than one row of reinforcements then the cage can include one or more support members at each level of reinforcement.

In the arrangement discussed earlier in which two vertically spaced reinforcements diverge from each other in plan view, these reinforcements may converge in elevation view so as to be supported at the same level. Thus the reinforcement support means supports at the same level two reinforcements which are vertically spaced on the rear member of the facing unit, these reinforcements being laterally spaced where they are supported. This can simplify the construction of the support means particularly where the facing unit has e.g. four rows of reinforcements, requiring only two levels of support.

In a preferred method, each upright member of the support cage has an inverted "V" or "U" shape and can be interconnected by lateral support members at any appropriate level. Another form of cage has "L" shaped upright members interconnected by lateral support members. The cages will generally be sufficiently rigid for the purpose of correctly positioning the reinforcements and might for example be formed of conventional 15 mm diameter steel reinforcement bars. Although the cage is left in position during backfilling of the facing unit and therefore becomes embedded in the stabilized earth structure, it does not act as an anchor for the flexible reinforcements so that their ability to flex when adapting to settlement of the structure is not impaired. This is partly because the cage is only semi-rigid in the context of the forces involved and partly because the reinforcements are generally only weakly connected to the cage e.g. by wire ties or tack welding.

The guide members will generally extend to the region of, and preferably above the water surface where the facing units can be engaged therewith for guided lowering. In order to ensure parallelity of the guide members a floating spacer member can be provided between the or each pair of guide members to give the correct spacing thereof at water level. When a facing unit is to be lowered between two guide members on to a base unit, it will normally be necessary first to remove the respective spacer member. In such circumstances the spacer member may be subsequently returned to its floating position, but may not be necessary since the facing unit serves to position the guide members.

In one possible method of construction, the or each reinforcement is arranged to be pivotable generally about its end attached to the facing unit so that its free end can be retained above the water level while the unit i being lowered, and then subsequently caused or permitted to pivot on to the earth to be stabilised. In this manner attachment of the or each reinforcement to the facing unit can be effected out of the water at any convenient location e.g. on a barge rather than under water.

In a preferred method, retaining means is provided to retain the free end of the or each reinforcement above the water. This will normally be necessary while the facing unit is being lowered and during backfilling up to the level of reinforcement. The retaining means may be provided on the spacer member for the guide members referred to earlier, or alternatively separate retaining means may be provided. In a preferred method, the retaining means comprises a beam adapted to float and including at least one retaining element for the or each reinforcement attached to the facing unit e.g. a guide tube or the like, while the beam is additionally adapted to function as a spacer member. The or each reinforcement is preferably sufficiently stiff to be retained in a generally vertical orientation by the retaining means without any need to be positively engaged thereby. With such an arrangement the retaining means can be lifted upwards so as to become disengaged from the vertical guide members and then moved away from the facing unit, for example across the surface of the water, whereby the or each reinforcement moves out of contact with the retaining means and pivots downwardly on to the earth to be stabilised.

In a preferred method, the free ends of a plurality of reinforcements attached in a row to a facing panel are retained above water by a floating retaining member having a plurality of laterally spaced guide tubes, one for each reinforcement. When the retaining member is moved away from the facing panel the reinforcements can simply slide out f their respective guide tubes.

Preferably the or each reinforcement is pivotably attached to the facing unit. It is known from U.S. Pat. No. 4,440,527 to attach a reinforcement in the form of an elongate flat steel strip to a facing unit by using an intermediate plate rigidly connected to the strip and pivotably connected to the facing unit. In accordance with a preferred feature of the invention there is provided a construction unit for an under water stabilised earth structure, comprising a facing panel and at least one elongate flexible reinforcement pivotably attached thereto for movement in a vertical plane, the or each reinforcement comprising a substantially flat, one-piece strip e.g. of steel, pivotably attached to the facing panel by a horizontally arranged spindle such as a bolt which passes through an aperture in an end portion of the strip, said end portion being twisted through substantially 90° to the remainder of the strip so that when the strip pivots to lie on the earth, the greater part of its length is arranged with the flat faces horizontal. Such an arrangement conveniently permits the strip to be pivotable in a vertical plane while giving the most favourable orientation of the strip to achieve earth stabilisation. In fact, such a reinforcement strip itself constitutes a preferred feature of the present invention.

The length of the reinforcement strip will generally be kept to a minimum consistent with the stability of the structure, to minimise the quantities of backfill and any excavation of the site which may be necessary. In general, the strip will be sufficiently rigid in relation to its length to withstand its own buckling forces during installation of the construction unit and the pivoting of the strip from the upright position to the horizontal. Susceptibility to buckling of the strip can be reduced either by rolling the strip with a slight curve in its transverse cross section, similar to a conventional steel tape measure, or by rolling the strip with a continuous longitudinal rib on one or both faces. Alternatively, the construction unit can be used with retaining means which provides support for the strip over a substantial part of its length e.g. a relatively long guide tube.

In accordance with another preferred feature of this invention, there is provided a construction unit for an under water stabilised earth structure, comprising a facing panel and a plurality of substantially horizontal, vertically spaced rows of discrete elongate flexible reinforcements, each reinforcement being pivotable generally about an end attached to the facing panel into an upright orientation in which all reinforcements lie in the same general plane, and the reinforcements of each row being laterally offset relative to those of the other row or rows such that when all the reinforcements are in the upright orientation they do not overlap or interfere with each other. Such a unit is particularly suitable for use in a preferred form of the construction method described above, in which a plurality of reinforcements initially have their free ends retained above the water level.

A preferred construction method using such a unit comprises retaining the free ends of all the reinforcements above water until the facing panel has been backfilled with earth up to the level of the lowest row of reinforcements, releasing these reinforcements such that they pivot on to the backfilled earth, backfilling again up to the level of the next row of reinforcements, and then releasing these reinforcements such that they pivot on to the earth. One particularly preferred method of doing this using a construction unit having two reinforcement rows comprises providing a pair of separably connected floating retaining members associated with the construction unit, each of said retaining members being associated with a respective row of reinforcements of the unit and providing retaining means therefor, whereby one retaining member can be removed to release the free ends of the lower row of reinforcements while the other retaining member remains in the floating position to retain the free ends of the upper row of reinforcements above the water. It will be appreciated that when the reinforcements of the lower row are laterally offset relative to those of the upper row, the retaining elements of one retaining member, such as a row of guide tubes, will be likewise laterally offset from the retaining elements of the other retaining member. This has the advantage, for example, that two rows of guide tubes each attached to a respective retaining member will not interfere with each other. Of course, if the construction unit includes more than two reinforcement rows then a corresponding number of separately removable retaining members may be used.

It will thus be seen that it is most convenient during construction of a stabilised earth structure under water that adjacent rows of reinforcements should be laterally offset. In accordance with another preferred feature of the invention, therefore, there is provided a stabilised earth structure comprising a plurality of substantially horizontal, vertically spaced rows of discrete elongate reinforcements embedded in an earth mass to provide stabilisation, the reinforcements of each row being laterally offset with respect to those of at least one of the vertically adjacent rows. Generally the structure will comprise a plurality of like construction units each including a facing panel and a pair of reinforcement rows, so that the reinforcements of each row will be laterally offset with respect to those of both vertically adjacent rows.

When stabilised earth structures are constructed on dry land, the backfill can be placed and compacted on each layer of reinforcements in a conventional manner. However, backfilling presents special problems when a series of compacted layers of earth must e built up under water, and various backfilling methods are possible. For example, the backfill could be placed hydraulically, which would consist of discharging water and backfill simultaneously in order to help compact and obtain a fairly level surface of backfill. Another method would consist of using a floating wooden or tubular aluminum (e.g. filled with styrofoam) grid attached to a backfilling barge. The grid compartments would guide the location and quantity of backfill placement. The width of the floating grid could be either the same as the lateral extent of a facing unit or more in order to backfill ore than one unit at a time, while the grid length would be determined by the strip length. A clamshell would be lowered through each grid space to a predetermined level above the reinforcements, for example 2 m, where a bucket of backfill would be dropped. This would help disperse the backfill and the clamshell could also be dropped to help spread and compact the layer of backfill.

It is generally desirable to achieve accurate and even placement of backfill and thus in accordance with a further preferred feature of the invention, there is provided a method of backfilling the facing of a stabilised earth structure under water, comprising lowering a frame into position behind the facing, the frame comprising a plurality of compartments divided by vertical walls and open at the top and bottom, placing backfill in each compartment through the open top thereof, and raising the frame so as to leave the backfill in position behind the facing. Although the backfill may be hydraulically placed it is preferably deposited by a clamshell. It is envisaged that the frame will be vibrated during raising so as to compact the backfill, and to assist further the raising will be done slowly. The quantity of backfill required per compartment might be determined by trial and error during construction. Suitable backfill material might be sand or gravel.

A potential disadvantage of this backfilling method is that it would be difficult to know the precise location of each compartment of the frame e.g. with respect to a crane boom. Thus in a more preferred method the backfill frame is used in conjunction with a floating grid, e.g. of the type referred to earlier, which gives an indication on the water surface of where each compartment is located.

The frame may include one, or preferably two, upright member(s) long enough to project out of the water so as to provide a reference for positioning the frame relative to the facing and the floating grid relative to the frame. The floating grid would be aligned with the upright member(s) and would have a grid arrangement corresponding to the frame compartments in order to aid in the placement of backfill using e.g. a clamshell.

Some embodiments of the invention will now be described, by way of example only, with reference to the accompanying drawings in which:

FIG. 1 shows a typical section of a stabilised earth structure constructed under water;

FIG. 4 is a sectional view of the base unit of FIG. 3;

FIG. 5 is a horizontal section through an end of the base unit where a guide member is supported;

Figure 13:
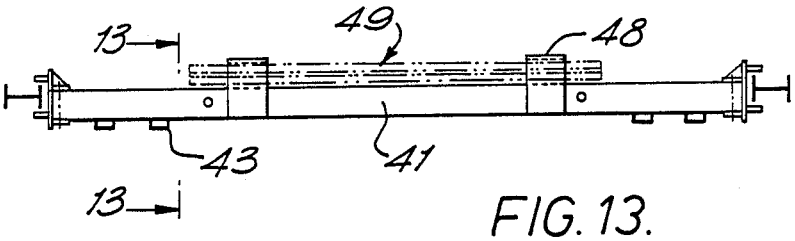
Figure 14:
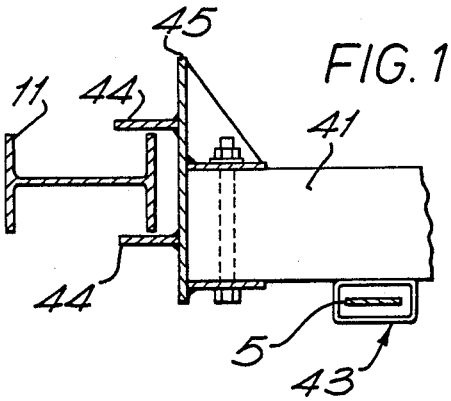
Figure 15:
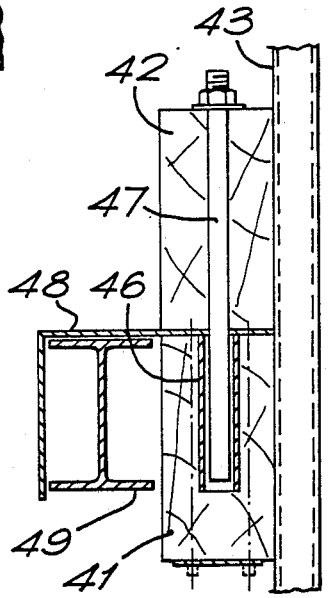
Figure 16:
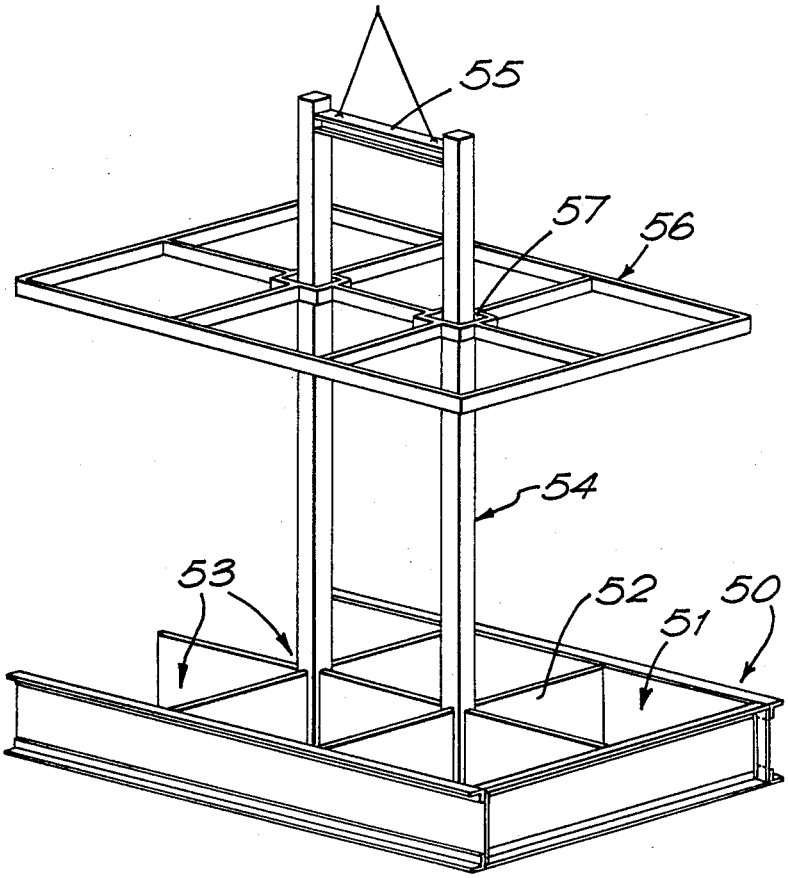
Figure 17:
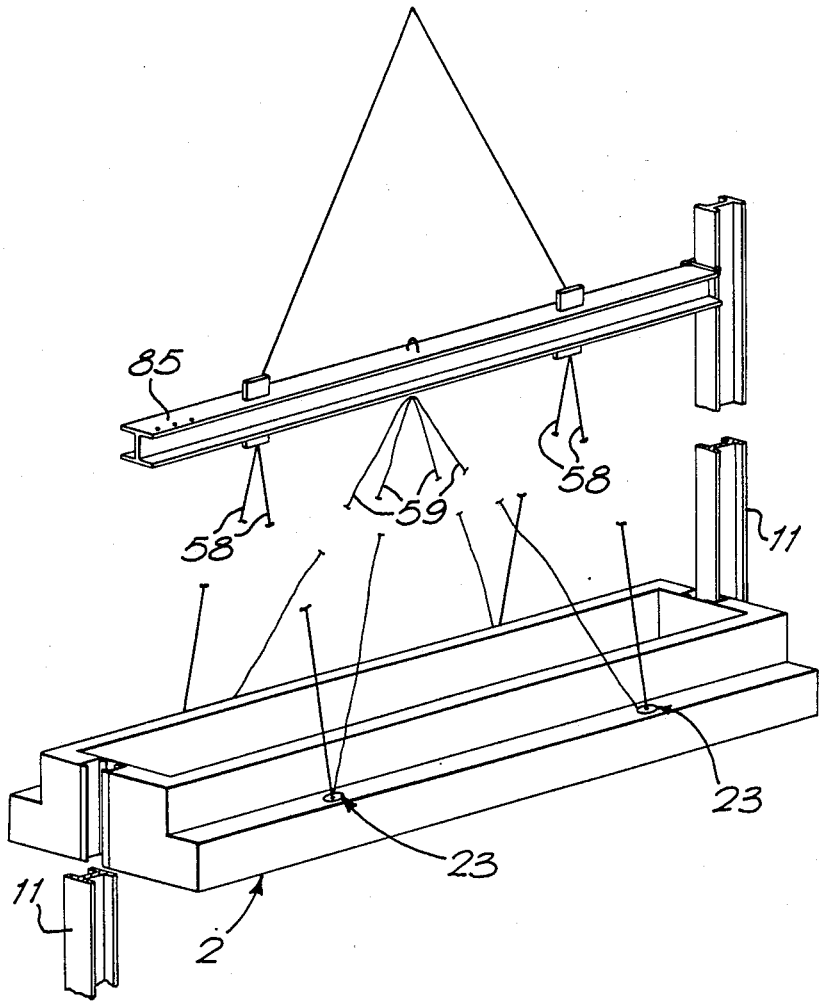
Figure 18:
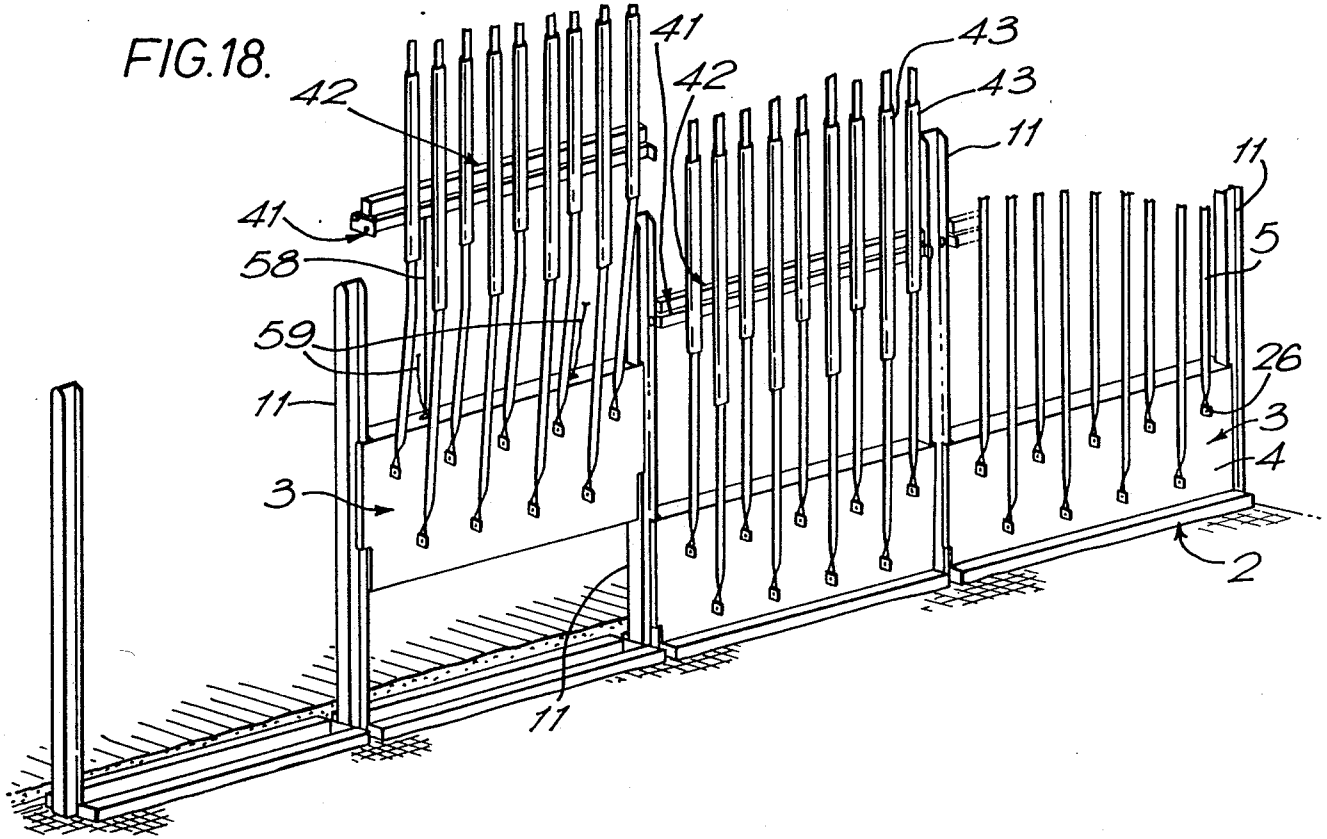
Figure 19:
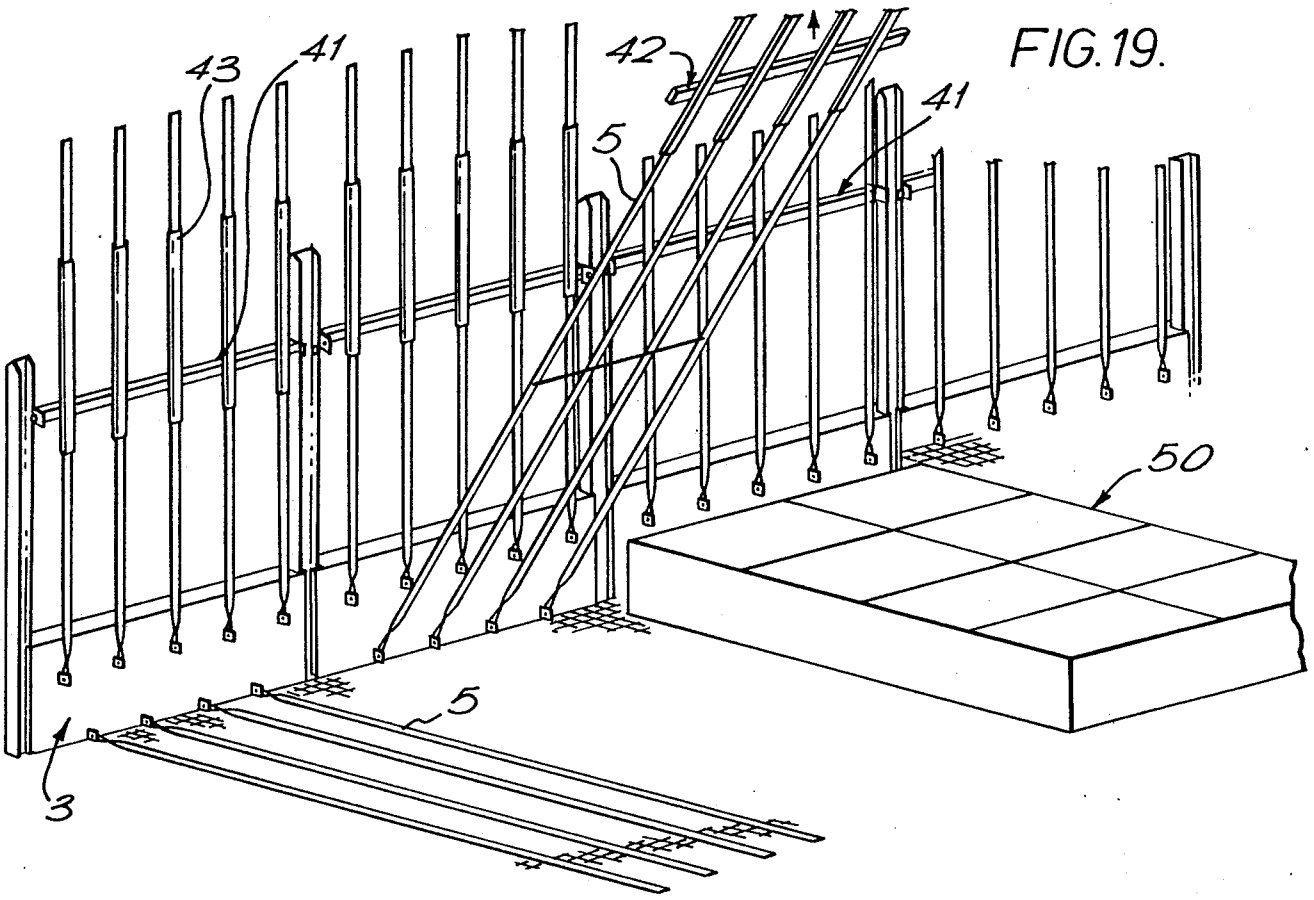
Figure 23:
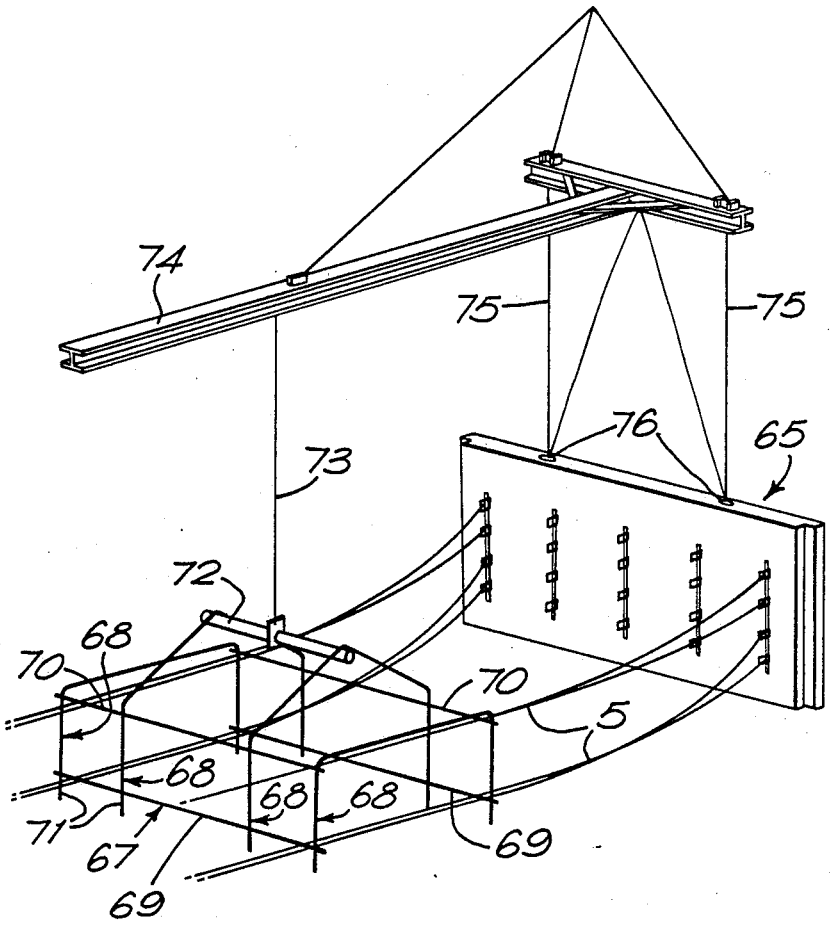

FIG. 5*a* is an elevation view of the guide member of FIG. 5;

FIG. 6 is an end elevation of the base unit;

FIG. 7 is a plan view of a typical facing unit;

FIG. 8 is an elevation of the rear of the facing unit;

FIG. 9 is a section through a guide member and two adjacent facing units;

FIG. 10 is a plan view of an elongate reinforcement, showing its attachment to a facing unit to form a first embodiment of a construction unit;

FIG. 11 is an elevation of the reinforcement of FIG. 10;

FIG. 12 is a partial perspective view of retaining means for two rows of reinforcements;

FIG. 13 is a plan view of retaining means which also acts as a spacer beam to space a pair of guide members;

FIG. 14 shows further details of the engagement of the spacer beam and a guide member;

FIG. 15 is a section on 15—15 of FIG. 13;

FIG. 16 s a perspective view of a backfill frame and floating grid;

FIG. 17 is a perspective view showing a base unit being lowered;

FIG. 18 is a perspective view showing two construction units of the first row in position on their respective base units and a third being lowered;

FIG. 19 is a later stage in the construction sequence;

FIG. 20 is a rear elevation of a second embodiment of construction unit for the first row;

FIG. 21 is a general vertical section through the unit of FIG. 20;

FIG. 22 is a plan view of the unit of FIG. 20;

FIG. 23 is a perspective view of the lowering of a third embodiment of construction unit for the second and subsequent rows.

Figure 2:
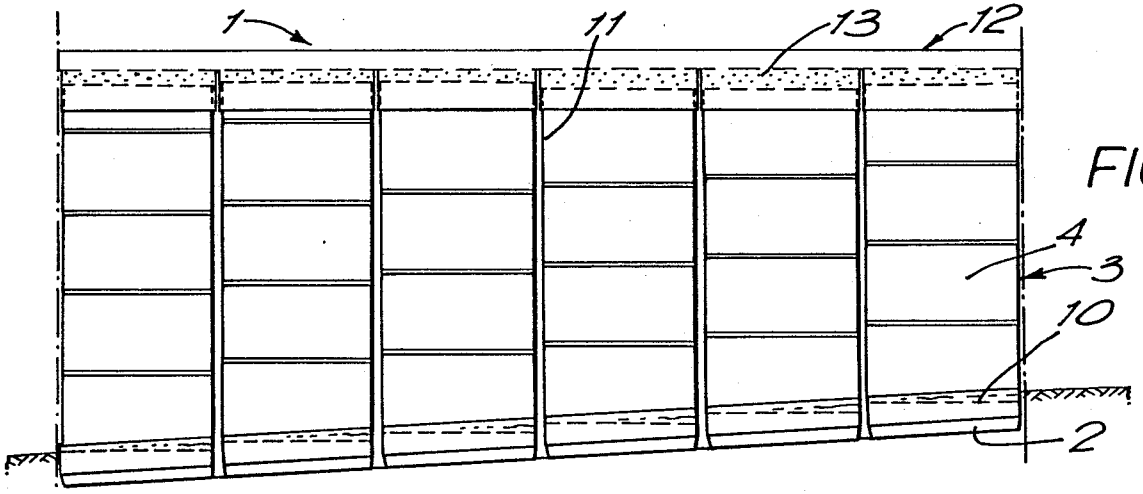
FIG. 2 is a typical front elevation of the structure.

Referring firstly to FIGS. 1 and 2, these show a stabilised earth structure 1 including a row of base units 2 which support a number of rows of construction units 3, each of which comprises a facing unit or panel 4 and two vertically spaced rows of pivotably mounted reinforcements 5. A dredged or otherwise constructed trench 6 is partly filled with gravel to form a bed 7 thereof for supporting the base units 2. The trench is filled with crushed stone 8 and a line of coarser material 9 is used in front of the structure to provide scour protection. Each base unit includes a levelling pad 10 of concrete which is still fluid when the base unit is first lowered into position so that the facing pad can be installed horizontally even if the existing grade is sloped, as seen in FIG. 2. A row of guide members 11 comprising steel H-sections extend upwardly to provide guidance in positioning the facing panels 4. The guide members are supported by the base units and extend out of the water, the level of which is indicated at W. The guide member may be fabricated with a point at the top to aid in the insertion of facing panel 4. The facing panels are placed one on top of the other between adjacent guide members and the top panel is in each case of a height selected to provide the required supporting position for a row of precast coping units 12. These are mounted on a beam of filler concrete 13 which is poured after the structure has settled, the coping units extending rearwardly across a layer of filter material 14.

Figure 3:
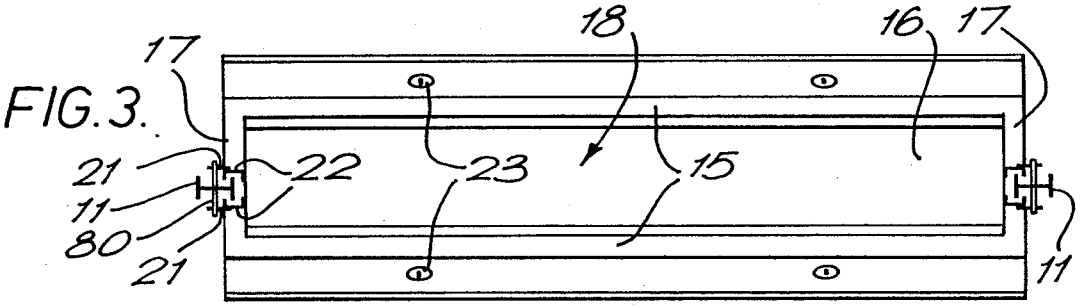
FIG. 3 is a plan view of a base unit of the structure.

A typical base unit is illustrated in greater detail in FIGS. 3 and 4. The unit is formed of reinforced concrete and is generally U-shaped in transverse section, having a pair of opposed side walls 15 connected by a seat portion 16. The two ends of the U-shaped section are each closed by an end wall 17 so as to provide an elongate box 18 for receiving rapid hardening concrete to form the levelling pad 10. The concrete is topped with fresh water 19 and optionally covered by a steel lid 20 which protects the fresh concrete when the base unit is lowered into the water, particularly by preventing the entry of backfill into the box 18. The seat portion 16 is reinforced to withstand the lifting loads exerted via four rapid lift anchors 23 provided therein and also to withstand some wave action in the initial stage of construction. The width of the base unit varies in accordance with the overall height of the facing so that additional space can if necessary be provided for brackets which brace the first row of facing panels. The height of the base unit also varies in accordance with the depth of the concrete levelling pad 10 required by the slope of the gravel bed 7.

The end wall 17 is shown in greater detail in FIGS. 5 and 6. A pair of spaced and parallel channel section members 22 are bolted to each end wall so as to define a vertically extending slot 82 which provides lateral support for a guide member. A support plate 21 extends outwardly from each channel section member 22 and is formed with a hole 81, the holes of the two plates 21 being aligned so as to receive a pin 80 which passes through a corresponding hole in a guide member 11. Thus if the site slopes then the guide members can be pivoted to a limited extent about the pin 80 to the vertical position.

The support for the guide members is arranged such that each guide member is supported equidistantly between adjacent base unit end walls. The guide member 11 shown in FIGS. 5 and 5*a* has secured to the outer flange thereof wedge members 83 to ensure that the slot 82 defined in the end wall 17 of the next base unit to be lowered adopts the correct position relative to the guide member and hence also the base unit already in position. The first base unit to be lowered in the water carries a pin 80 supporting a guide member at each end thereof, while subsequent base units only require a pin at the one end where each additional guide member is supported.

A typical facing unit or panel is shown in FIGS. 7 and 8. The unit is formed of concrete reinforced to withstand all earth pressures behind the facing as well as mooring loads, dynamic debris loads and, where applicable, ice loads. At each side edge 24 of the facing panel an angle section member 25 is vertically mounted for engagement with a guide member 11. Two vertically spaced and horizontal rows of attachment points 26 for the reinforcements 5 are provided at the rear of the facing panel, each attachment point including a pair of vertical parallel steel plates 27 cast in to the panel and projecting from its rear face. The attachment points of the upper row are laterally offset from those of the lower row so as to avoid interference of the reinforcements 5 when they are in the upright position during installation and backfilling of the facing panel. Since the horizontal and vertical joints between facing panels are virtually sealed e.g. by compressible polyurethane secured to the lower edge 28 of each panel for the horizontal joints and by grouting the guide members for the vertical joints, a pair of steel filter pipes 29 are embedded in the concrete during precasting. Each pipe has a wire mesh grid at the front and back and is filled with filter material between the grids. If the structure is to be built in a river where the draw down is rapid then additional filter pipes may be required. A pair of rapid lift anchors 30 are cast into the upper edge of the facing panel for suspending and lowering the panel.

Further details of a facing panel and its engagement with a guide member are shown in FIG. 9. At one corner of each side edge 24 of the panel a fixing member 31 comprising an angle section is cast into the concrete and the angle section member 25 for guidance of the panel is welded thereto. The vertical joint between adjacent facing panels includes a vertically extending cavity 32 in front of the web of the H-section guide member 11 and behind two laterally projecting portions 33 of the facing panels. This cavity is occupied by a filter fabric bag 34 which is glued to the guide member and initially held in place by a pair of ropes 35 e.g. of nylon. Alternatively tape may be used. A grout tube 36 extends inside the bag 34 so that when the facing panels have been installed and settlements have taken place the ropes 35 can be released and grout material discharged into the bag whereby the cavity 32 is filled and the vertical joint sealed. As an alternative to grouting, crushed stones and sand may be used to fill the bag.

Each facing panel in the first row thereof fits between the side walls 15 of a respective base unit and sits on the concrete levelling pad 10. If the first row facing panels are placed in deep water e.g. water deeper than about 6 m, then brackets are provided at the front and back of the panels to provide additional bracing on the levelling pad 10. The facing panels in the top row are similar to the typical panel described above except that they vary in height to suit the shape of the top of the facing.

FIGS. 10 and 11 show further details of the attachment of a reinforcement 5 to a facing unit or panel 4 so as to form a construction unit 3. The attachment point 26 comprises two spaced parallel steel plates 27 projecting from the rear face of the facing panel and a bolt extending horizontally through holes in the plates and locked there by a pair of nuts 37. The reinforcement 5 has an end portion 38 formed with a hole 39 which loosely receives the bolt between the two plates so as to be pivotable in a vertical plane. A typical bolt might be 2 inches (51 mm) long by $\frac{5}{8}$ inch (16 mm) diameter with a shank sufficiently long so that the nuts cannot be tightened such that the plates grip the reinforcement. Suitable reinforcements for under water construction are high tensile steel strips, galvanized and 70×6 mm for fresh water, and non-galvanized and 70×8 mm for sea water. The strips lie with their flat faces horizontal for the greater part of their length and their flat faces vertical in the vicinity of the bolt hole 39, and are therefore twisted through 90°. The length of the twist 40 would typically be 1.0 to 1.5 m.

FIGS. 12 to 15 show one possible arrangement for spacing two adjacent guide members 11 at water level and for selectively retaining the reinforcements above water. The arrangement comprises a spacer beam 41 carrying on its upper surface an upper beam 42, at least the lower of the beams, and preferably both, being adapted to float e.g. by being formed of a hardwood. Both beams are provided with a plurality of spaced retaining elements in the form of vertically extending guide tubes 43, formed for example of aluminum, each tube acting to retain a respective reinforcement 5 and being outwardly flared at its ends to assist insertion of the reinforcement and to prevent snarling thereof on the end of the tube. Styrofoam sheets may be attached to the guide tubes to increase the buoyancy of the beams. The spacer beam 41 retains the free ends of the upper row of reinforcements, while the upper beam 42 retains the free ends of the lower row of reinforcements. The spacer beam 41 is adapted at its two ends to engage adjacent guide members 11 to keep them spaced apart at water level, while the upper beam 42 is provided simply as retaining means for the lower row of reinforcements. Engagement of the spacer beam 41 with the guide member is effected by a pair of parallel plates 44 secured to a plate 45 secured to each end of the beam. Each pair of plates 44 engages the ends of the flanges of the H-section guide member 11, as seen in Figure 14. A pair of recesses are provided in the upper face of the spacer beam and are each lined with a pipe sleeve 46 which receives a corresponding downwardly projecting steel pin 47 of the upper beam 42. A pair of steel brackets 48 are also secured to the upper face of the spacer beam 41 so that a spreader beam 49 can engage under the brackets to lift the spacer beam 41. Brackets (not shown) are also provided for the upper beam 42 so that it can be separately lifted. The spreader beam 49 is also used to support suspension elements 58 for carrying the base and construction units.

FIG. 16 illustrates one possible arrangement for backfilling the facing of the structure. A steel frame 50 comprises a network of compartments 51 divided by vertical walls 52 and open at the top and bottom. The two compartments 53 which are to be nearest the back of the facing are open at the front so that the backfill can be placed right up to the facing. The frame includes two upright steel tube sections 54 which are long enough to extend above the water when the frame is at the base of the facing. The upright tubes 54 are bridged at their upper ends by a lifting girder 55. A floating grid 56 having compartments corresponding to those of the frame 50 is arranged to be located directly above the frame 50 on the water surface by means of a pair of windows 57 in the grid which receive the upright tubes 54.

A preferred method of constructing a stabilised earth structure under water will now be described with particular reference to FIGS. 17, 18 and 19. A trench 6 is dredged to approximately 1.5 m below the existing sea, lake, river etc. bed using a dredging barge and a gravel bed 7 approximately 0.5 m thick is placed in the trench as level as possible (see FIG. 1). A first base unit 2 which is to support the facing panels at one end of the structure is filled with an amount of concrete determined by the slope of the gravel bed, and topped with fresh water. A guide member 11 is attached to each end of the base unit which is lowered into the water by means of suspension elements 58 which engage the lift anchors 23, there being slack lines 59 for releasing the suspension elements from the anchors when the base unit is installed. The suspension elements are connected to a base unit lifting beam 85. A buoy might be attached by a line to the base unit to provide alignment verification for the guide members on the water surface. If the site is on a slope then the pivotal connection of the guide members to the base unit permits the guide members to be adjusted to a vertical position. FIG. 17 shows a subsequent base unit 2 supporting only one guide member 11 about to be lowered into a guide member already in position. Subsequent base units are installed in a direction of construction until the entire row of base units is in position, each base unit being lowered in a similar manner to the first unit except that they each only carry one guide member 11 at one end, as seen in Figure 17.

When a row of base units has been installed in the direction of construction, the units are backfilled with gravel up to near their tops e.g. to within 100 mm, as shown in FIG. 18. A first construction unit 3 to be placed on the first base unit 2 is then assembled at an assembly station, e.g. on a barge, by pivotably attaching two rows of steel reinforcement strips 5 to a facing panel 4. At this stage the panel lies on its front face and the strips extend horizontally to where their free ends can be fitted through respective guide tubes 43. The appropriate spacer beam 41 is removed from between the two guide members which are to receive the facing panel so that the upper row of strips can be inserted through the guide tubes of the spacer beam while the lower row of strips are inserted through the guide tubes of an upper beam 42. The spreader beam 49 (FIGS. 13 and 15) is attached to the facing panel by means of suspension elements 58 and is engaged under the brackets 48 of the spacer beam 41. It is then lifted upwardly, for example by a crane. The panel tilts into an upright position, vertically spaced from the spacer beam by a distance determined by the length of the suspension elements. The reinforcement strips then extend vertically from the panel through their respective guide tubes. After ensuring that no backfill has come to rest in the first base unit the facing panel is lowered between the guide members and the parallel plates 44 of the spacer beam are guided on to the guide members. The spacer beam detaches itself from the spreader beam as soon as the latter is lowered below water level. The spacer beam 41 and the upper beam 42 thus remain floating connected by the pins 47. The guide tubes 43 of the spacer beam are laterally offset relative to those of the upper beam and also extend to a greater depth into the water to allow for the lower level at which the reinforcement strips which the tubes retain are attached to the facing panel. When the facing panel is in position on the base unit the suspension elements are disconnected by means of the slack lines.

The process of installing construction units is continued in the direction of construction until the first row of such units is placed. All the panels are then backfilled in the same direction and using one of the methods described earlier, up to the lower level of reinforcement strips which remain upright during backfilling. The spreader beam is then used to lift the upper beam associated with the first construction unit by its brackets clear of the guide members, leaving the spacer beam afloat and retaining the upper level reinforcement strips. The upper beam is moved away from the facing, as seen in FIG. 19, causing the lower level strips to pivot about their attachments towards the backfill until they slide completely out of the guide tubes and fall into position on the backfill. The process of removing the upper beam is repeated for all the lower level strips and the facing is then backfilled up to the upper level strips. The spreader beam is connected to the spacer beam associated with the first construction unit and the spacer beam is lifted clear of the guide members and moved away from the facing in the same way as the upper beams were moved, thereby causing the upper level of strips to pivot towards and eventually fall onto the backfill.

A second row of facing panels is then installed and backfilled in the same manner as the first row, and the process is continued until all the panels which are below the water level have been positioned. Subsequent panels which are installed above the water level in the dry can be positioned by using the spreader beam before their reinforcement strips are attached. The strips can be attached in the conventional way once backfilling is complete to the level of the strips. Once the last row of facing panels is installed and settlements have taken place the nylon ropes 35 are released and filter fabric bags 34 are filled with grout through tube 36. The concrete filler beam 13 is then cast in place to obtain a level surface. Pre-cast coping units 12 are installed having reinforcement projecting out of their rear horizontal legs to enable additional slabs to be cast in place above the stabilised earth.

The construction method is particularly suitable for structures up to about 5 m high. In deeper water where a higher wall is required the row of base units can be installed above the sea bed on another structure, for example a stabilised earth structure including facing panels lowered into position with attached horizontal steel reinforcements secured in steel cages as described above.

Such a construction method, using substantially horizontal reinforcements secured in steel cages, is in fact particularly suitable for structures in deeper water where the overall height of the wall to be constructed requires relatively long reinforcements. A second embodiment of construction unit 61 suitable for this method differs primarily from the first embodiment in the manner of attachment of the reinforcement strips 5 to the facing panel 62. The unit shown in detail in FIGS. 20 to 21 is an example which might be used for the first course of construction units resting on the base units. On the back of the facing panel 62 five vertical pipes 90 are secured at a spacing from the back surface of the panel, each pipe slidably supporting three pairs of horizontal attachment plates 63. Each attachment plate has a vertical hole rearwardly of the pipe and the holes of each pair are aligned to receive a bolt which retains a respective reinforcement strip 5 between the pair of plates. The slidable attachment of the strips to the panel enables settlement of backfill to be accommodated.

An alternative form of attachment which allows for backfill settlement includes a pair of vertical parallel steel plates cast into the facing panel and projecting from its rear face, similar to the first embodiment. However, instead of being formed with holes, the plates are each formed with a vertically extending slot through which a bolt mounting the reinforcement strip extends. The bolt fits loosely in the slots so as to be vertically slidable, while substantially the remaining portion of the slots is filled with a compressible material. This arrangement allows for unknown backfill settlements by permitting downward movement of the reinforcement strip 5 where it is attached to the facing panel.

The first course facing panel 62 shown in FIG. 20 includes at each end a shaped block 64 of ethafoam or other suitable material to assist in positioning the panel in the elongate box provided by the base unit into which the panel is to be lowered.

FIG. 23 illustrates the step of lowering a third embodiment of construction unit 65 for the second and subsequent courses, this unit including four rows of reinforcement strips 5 attached by a vertical pipe arrangement to a facing panel 66(the inner reinforcements of each row being omitted for clarity).

Spaced from the facing panel along the length of the reinforcement strips there is provided a cage 67 for supporting the strips each in a horizontal position. In this embodiment the cage is formed of 15 mm steel reinforcement bars and includes four laterally spaced upright members 68 comprising such bars bent into an inverted general "U" shape. These upright members 68 are interconnected by a pair of lower lateral members 69 for supporting reinforcements at a lower level, and by a pair of upper lateral members 70 for supporting reinforcements at an upper level. The lower lateral members 69 provide support for the reinforcements of the two adjacent lower rows thereof. Reference is made to FIG. 22 for further details of the arrangement of the reinforcements, in which the reinforcements of adjacent rows which are attached to the same vertical pipe 90 diverge from each other when viewed in plan, thereby enabling fewer vertical pipes to be used for a given number of reinforcements attached to the panel. Since the reinforcements diverge in this manner, they only require one level of support by the cage 67, and therefore converge in elevation view, as seen in FIG. 21. The arrangement for the third embodiment of construction unit used in second and subsequent courses is similar, there being four rows of reinforcements supported at two levels, as seen in FIG. 23.

A hanger pipe 72 is used to carry the cage 67 during lowering thereof. As illustrated the hanger pipe fits beneath the apexes of two adjacent upright members 68 and may include a pair of depressions in its top surface to assist in retaining the upright members. The hanger pipe 72 is itself supported by a suspension element 73 to which it is eccentrically connected so that the hanger pipe will tilt to vertical when unloaded and can then be removed from the region of the cage. The suspension element 73 is connected to a lifting jig 74 which also carries further suspension elements 75 connected to anchors 76 of the facing panel. Thus the lifting jig 74, itself carried by e.g. a crane, provides a common support for the facing panel and the hanger pipe so that it is possible to select the lengths of the suspension elements 73 and 75 such that the reinforcement strips are positioned generally horizontally during lowering. The two lower end portions 71 of each upright member act as a pair of legs which rest on or penetrate the existing ground or backfill level as necessary to support the reinforcements in the horizontal position.

The method of construction of a stabilised earth structure under water using the second and third construction unit embodiments is similar to that already described in relation to the first embodiment, except in the following respects. Having installed and backfilled the base units 2, the construction unit 61 is assembled by attaching three rows of reinforcement strips 5 to the facing panel 62 and the unit is then suspended from the lifting jig together with the cage 67 for supporting the reinforcement strips. The whole assembly is then lowered into the water with the strips supported in a generally horizontal position until the legs 71 of the cage 67 engage the backfill. The suspension elements 75 are disconnected from the facing unit and the hanger pipe 72 is disengaged from the cage by continued lowering so that it pivots to the vertical. The facing unit is thus left in position on the concrete levelling pad 10 with the attached reinforcement strips supported horizontally. In deep water, where longer reinforcement strips are required, more than one support cage 67 might be used spaced at intervals along the length of the strips. The facing unit is then backfilled, preferably using the floating grid described earlier as a guide, and preferably by dropping the backfill on the cage or cages first and then on the rest of the strips. In this way both rows of reinforcement strips are backfilled at the same time, backfilling taking place up to the upper level of reinforcements, as seen in FIG. 21. The level of the backfill is checked by either electronic or manual sounding. Once the first row of construction units 61 has been installed and backfilled then the second row of construction units 65 can be similarly installed, and the process is continued until the structure is of the required height.

We claim:

1. A method of constructing a stabilised earth structure under water, comprising lowering a base unit on to a site under water, lowering into a position immediately above said base unit a facing unit to which is attached at least one elongate flexible reinforcement for stabilising the earth, the facing unit being guided during lowering by at least one guide member connected to the base unit, and backfilling the base and facing units with earth to cover the or each reinforcement, wherein the base unit comprises an elongate box and support material is introduced into said elongate box to provide means for supporting said facing unit with its lower edge horizontal, the guide member being substantially rigid and connected to the elongate box such that the rigid guide member is adjustable to a vertical orientation.

2. A method as claimed in claim 1, wherein the support material is concrete which remains fluid until the elongate box is installed on the site, so that when the concrete hardens it provides a horizontal pad for supporting the facing unit when the latter is lowered into position.

3. A method as claimed in claim 1, wherein a plurality of elongate boxes are lowered to form a row thereof with a respective guide member between adjacent boxes and at each end of the row, and wherein facing units are lowered between the guide members to form a row thereof.

4. A method as claimed in claim 3, wherein each guide member is provided with a vertically extending bag into which sealing material is introduced to form a seal between adjacent facing units.

5. A method as claimed in claim 1, wherein the or each reinforcement is attached to the facing unit by means which permits limited downward movement of the reinforcement relative to the unit so as to allow for unknown backfill settlements.

6. A method as claimed claim 5, wherein a plurality of vertically spaced reinforcements are attached to a vertically extending elongate member on the rear of the facing unit.

7. A method as claimed in claim 6, wherein the reinforcements are supported by means disposed at a location along their length spaced from the facing unit such that both during and after lowering the unit into position the reinforcements are supported substantially horizontally.

8. A method as claimed claim 7, wherein the reinforcement support means supports at the same level two reinforcements which are vertically spaced on the rear elongate member of the facing unit, these reinforcements being laterally spaced where they are supported.

9. A stabilised earth structure at least partly under water, in which an under water base unit supports a facing unit to which is attached at least one elongate flexible reinforcement for stabilising the earth behind the facing unit, at least one guide member for the facing unit being connected to the base unit, wherein the base unit comprises an elongate box containing support material which supports the lower edge of said facing unit horizontally, the guide member being substantially rigid and adjusted relative to the elongate box to a vertical orientation.

10. A base unit for an under water stabilised earth structure, having connected thereto a guide member for a facing unit, wherein the base unit comprises an elongate box for containing support material to support a facing unit, the guide member being substantially rigid and connected to the elongate box such that the orientation of the guide member is adjustable.

11. A method of constructing a stabilised earth structure under water, comprising lowering a base unit on to a site under water, lowering into a position immediately above said base unit a facing unit to which is attached at least one elongate flexible reinforcement for stabilising the earth, the facing unit being guided during lowering by at least one guide member connected to the base unit, and said least one reinforcement being supported by means disposed at a location along its length spaced from the facing unit such that both during and after lowering the unit into position the at least one reinforcement is supported substantially horizontally, and backfilling the base and facing units with earth to cover said at least one reinforcement, wherein the base unit comprises an elongate box to provide means for supporting said facing unit with its lower edge horizontal, the guide member being substantially rigid and connected to the elongate box such that the rigid guide member is adjustable to a vertical orientation.

12. A stabilised earth structure at least partly under water, comprising an under water base unit, a facing unit supported by the base unit, at least one elongate flexible reinforcement attached to the facing unit for stabilising the earth behind the facing unit, support means for the at least one reinforcement disposed at a location along the length thereof at a spacing from the facing unit such that the at least one reinforcement is supported substantially horizontally during construction, and at least one guide member for the facing unit connected to the base unit, wherein the base unit comprises an elongate box containing support member which supports the lower edge of said facing unit horizontally, the guide member being substantially rigid and adjusted relative to the elongate box to a vertical orientation.

* * * * *